US010584618B2

(12) United States Patent
Hashimoto

(10) Patent No.: US 10,584,618 B2
(45) Date of Patent: Mar. 10, 2020

(54) SINTERED VALVE SEAT

(71) Applicant: KABUSHIKI KAISHA RIKEN, Tokyo (JP)

(72) Inventor: Kimiaki Hashimoto, Kumagaya (JP)

(73) Assignee: KABUSHIKI KAISHA RIKEN, Tokyo (JP)

( * ) Notice: Subject to any disclaimer, the term of this patent is extended or adjusted under 35 U.S.C. 154(b) by 126 days.

(21) Appl. No.: 15/778,039

(22) PCT Filed: Dec. 1, 2017

(86) PCT No.: PCT/JP2017/043303
§ 371 (c)(1),
(2) Date: May 22, 2018

(87) PCT Pub. No.: WO2018/179590
PCT Pub. Date: Oct. 4, 2018

(65) Prior Publication Data

US 2019/0360366 A1 Nov. 28, 2019

(30) Foreign Application Priority Data

Mar. 28, 2017 (JP) ..... 2017-063088

(51) Int. Cl.
*F01L 3/02* (2006.01)
*C22C 38/24* (2006.01)
(Continued)

(52) U.S. Cl.
CPC ..... *F01L 3/02* (2013.01); *B22F 1/0003* (2013.01); *B22F 5/106* (2013.01); *C22C 19/07* (2013.01);
(Continued)

(58) Field of Classification Search
CPC ..... F01L 3/02; B22F 1/0003; B22F 5/106; C22C 19/07; C22C 27/04; C22C 38/02; C22C 38/04; C22C 38/22; C22C 38/24; C22C 38/28
See application file for complete search history.

(56) References Cited

U.S. PATENT DOCUMENTS 4,424,953 A * 1/1984 Takagi ..... B22F 7/06 123/188.8
5,004,581 A 4/1991 Takagi et al.
(Continued)

FOREIGN PATENT DOCUMENTS

JP 56-071906 U 6/1981
JP 2-033848 B2 7/1990
(Continued)

OTHER PUBLICATIONS

International Search Report (PCT/ISA/210) issued in PCT/JP2017/043303, dated Jan. 23, 2018.
(Continued)

*Primary Examiner* — Jacob M Amick
(74) *Attorney, Agent, or Firm* — Birch, Stewart, Kolasch & Birch, LLP

(57) ABSTRACT

To provide a sintered valve seat having excellent valve coolability making it usable for high-efficiency engines, as well as excellent deformation resistance, wear resistance and detachment resistance, the valve seat is provided with a two-layer structure having a seat layer repeatedly abutting a valve face, and a support layer abutting bottom and inner peripheral surfaces of a valve-seat-press-fitting opening of a cylinder head; the seat layer containing at least one selected from Co-based hard particles and Fe-based hard particles in a matrix of Cu or its alloy; and the support layer containing at least one selected from Fe particles and Fe alloy particles in a matrix of Cu or its alloy.

15 Claims, 2 Drawing Sheets

(51) Int. Cl.

| | |
|---|---|
| ***C22C 38/22*** | (2006.01) |
| ***C22C 38/28*** | (2006.01) |
| ***C22C 38/04*** | (2006.01) |
| ***C22C 38/02*** | (2006.01) |
| ***C22C 27/04*** | (2006.01) |
| ***B22F 1/00*** | (2006.01) |
| ***B22F 5/10*** | (2006.01) |
| ***C22C 19/07*** | (2006.01) |
| *F02F 1/24* | (2006.01) |

(52) U.S. Cl.
CPC ..... *C22C 27/04* (2013.01); *C22C 38/02* (2013.01); *C22C 38/04* (2013.01); *C22C 38/22* (2013.01); *C22C 38/24* (2013.01); *C22C 38/28* (2013.01); *B22F 2301/10* (2013.01); *B22F 2301/15* (2013.01); *B22F 2301/20* (2013.01); *B22F 2301/35* (2013.01); *F01L 2101/00* (2013.01); *F01L 2103/00* (2013.01); *F02F 1/24* (2013.01)

(56) References Cited

U.S. PATENT DOCUMENTS

| | | | | |
|---|---|---|---|---|
| 5,975,039 | A | 11/1999 | Oshige | |
| 6,039,785 | A | 3/2000 | Dalal et al. | |
| 6,793,876 | B2 | 9/2004 | Kawakami et al. | |
| 7,089,902 | B2 | 8/2006 | Sato et al. | |
| 7,850,795 | B2 | 12/2010 | Kawasaki et al. | |
| 2004/0131492 | A1* | 7/2004 | Kawakami | C22C 19/07 419/60 |
| 2004/0187830 | A1* | 9/2004 | Sato | B21K 1/24 123/188.8 |
| 2006/0108029 | A1 | 5/2006 | Kawasaki et al. | |

FOREIGN PATENT DOCUMENTS

| | | | |
|---|---|---|---|
| JP | 3-060895 | A | 3/1991 |
| JP | 7-119421 | A | 5/1995 |
| JP | 10-184324 | A | 7/1998 |
| JP | 2004-232088 | A | 8/2004 |
| JP | 2005-256146 | A | 9/2005 |
| JP | 3786267 | B2 | 6/2006 |
| JP | 4272706 | B2 | 6/2009 |
| JP | 2015-014262 | A | 1/2015 |

OTHER PUBLICATIONS

Written Opinion (PCT/ISA/237) issued in PCT/JP2017/043303, dated Jan. 23, 2018.

* cited by examiner

SINTERED VALVE SEAT

FIELD OF THE INVENTION

The present invention relates to an engine valve seat, particularly to a press-fit, high-heat-transfer, sintered valve seat capable of suppressing the temperature elevation of a valve.

BACKGROUND OF THE INVENTION

To provide automobile engines with improved fuel efficiency and higher performance for environmental protection, recently, so-called downsizing which reduces engine displacement by 20-50% is accelerated, and direct-injection engines are combined with turbochargers to increase compression ratios. Improvement in the efficiently of engines inevitably results in higher engine temperatures, which may cause power-decreasing knocking. Accordingly, improvement in the coolability of parts particularly around the valves has become necessary.

As a means for improving the coolability of a valve, Patent Reference 1 discloses a method for producing an engine valve comprising sealing metal sodium (Na) in a hollow portion of a hollow valve stem in an engine valve. With respect to a valve seat, Patent Reference 2 teaches a method for directly buildup-welding a valve seat on a cylinder head of an aluminum (Al) alloy by using high-density heating energy such as laser beams to improve the coolability of a valve, which is called "laser cladding method." As an alloy for buildup-welding the valve seat, Patent Reference 2 teaches a dispersion-strengthened Cu-based alloy comprising boride and silicide particles of Fe—Ni dispersed in a copper (Cu)-based matrix, Sn and/or Zn being dissolved in Cu-based primary crystals.

The valve temperature during the operation of an engine is about 150° C. lower in the above metal-sodium-filled valve (valve temperature: about 600° C.) than in a solid valve, and the Cu-based alloy valve seat produced by the laser cladding method lowers the temperature of a solid valve by about 50° C. (valve temperature: about 700° C.), preventing knocking. However, the metal-sodium-filled engine valves suffer such a high cost that they have not been used widely except some vehicles. The Cu-based alloy valve seats produced by the laser cladding method, which do not contain hard particles, have insufficient wear resistance, suffering seizure by impact wear. Also, the direct buildup-welding on cylinder heads needs the drastic change of cylinder head production lines and large facility investment.

With respect to a valve seat press-fitted into a cylinder head, Patent Reference 3 discloses a two-layer, sintered iron based alloy valve seat comprising a valve-abutting layer (Cu content: 3-20%) and a valve seat body layer (Cu content: 5-25%) formed by using Cu powder or Cu-containing powder for improving thermal conduction, and Patent Reference 4 discloses a sintered Fe-based alloy having hard particles dispersed, which is impregnated with Cu or its alloy.

Further, Patent Reference 5 discloses a sintered Cu-based alloy valve seat, in which hard particles are dispersed in a dispersion-hardened Cu-based alloy having excellent thermal conductivity. Specifically, a starting powder mixture comprising 50-90% by weight of Cu-containing base powder and 10-50% by weight of a powdery Mo-containing alloy additive, the Cu-containing matrix powder being $Al_2O_3$-dispersion-hardened Cu powder, and the powdery Mo-containing alloy additive comprising 28-32% by weight of Mo, 9-11% by weight of Cr, and 2.5-3.5% by weight of Si, the balance being Co.

Though Patent Reference 5 teaches that the $Al_2O_3$-dispersion-hardened Cu powder can be produced by heat-treating Cu—Al alloy powder formed by atomizing a Cu—Al alloy melt, in an oxidizing atmosphere to selectively oxidize Al, there is actually a limitation to increase the purity of $Al_2O_3$-dispersion Cu matrix from an Al-dissolved Cu—Al alloy. Further, the Cu matrix exhibits lower yield strength at higher purity, so that a valve seat is likely detached from a cylinder head as a result of thermal yielding.

Thus, a valve seat capable of suppressing the temperature elevation of a valve on a level not less than those used in expensive metal-Na-filled engine valves, and having excellent wear resistance as well as excellent detachment resistance from a cylinder head, is desired.

PRIOR ART REFERENCE

Patent Reference 1: JP 7-119421 A
Patent Reference 2: JP 3-60895 A
Patent Reference 3: JP 10-184324 A
Patent Reference 4: JP 3786267 B
Patent Reference 5: JP 4272706 B

OBJECT OF THE INVENTION

In view of the above problems, an object of the present invention is to provide a sintered valve seat having excellent valve coolability to be usable for high-efficiency engines, as well as excellent deformation resistance, wear resistance and detachment resistance.

DISCLOSURE OF THE INVENTION

The inventor has conducted extensive research on a sintered valve seat having hard particles dispersed in Cu or its alloy having excellent thermal conduction, finding that with a two-layer structure comprising a seat layer having excellent heat resistance and wear resistance and high thermal conductivity, and a support layer having excellent deformation resistance and high thermal conductivity, the sintered valve seat can have excellent wear resistance and deformation resistance, as well as high valve coolability.

Thus, the sintered valve seat of the present invention is press-fitted into a cylinder head of an internal engine

- the valve seat having a two-layer structure comprising a seat layer repeatedly abutting a valve face, and a support layer abutting bottom and inner peripheral surfaces of a valve-seat-press-fitting opening of a cylinder head;
- the seat layer containing at least one selected from Co-based hard particles and Fe-based hard particles in a matrix of Cu or its alloy; and
- the support layer containing at least one selected from Fe particles and Fe alloy particles in a matrix of Cu or its alloy.

The seat layer preferably contains 25-70% by mass of at least one selected from the Co-based hard particles and the Fe-based hard particles, and the support layer preferably contains 30-70% by mass of at least one selected from the Fe particles and the Fe alloy particles. The support layer preferably has higher thermal conductivity than that of the seat layer.

Effects of the Invention

Because the sintered valve seat of the present invention has a two-layer structure comprising a seat layer containing Co-based hard particles and/or Fe-based hard particles in a high-thermal-conductivity matrix of Cu or its alloy for excellent heat resistance and wear resistance and high thermal conductivity, and a support layer containing Fe particles and/or Fe alloy particles for excellent deformation resistance and high thermal conductivity, it can provide improved valve coolability, reducing the abnormal combustion of engines such as knocking, etc., thereby contributing to improving the performance of high-compression-ratio, high-efficiency engines. Also, with the support layer densified to improve yield strength and thermal conductivity, its detachment from a cylinder head can be prevented. Further, because fine Cu powder is used, a network-shaped Cu matrix can be formed even with a larger amount of hard particles, and can be densified to improve strength and wear resistance while keeping high thermal conductivity.

BRIEF DESCRIPTION OF THE DRAWINGS

FIG. 4(*b*) is a scanning electron photomicrograph showing a cross-section structure of the support layer of Example 1.

DESCRIPTION OF THE PREFERRED EMBODIMENTS

Figure 1:
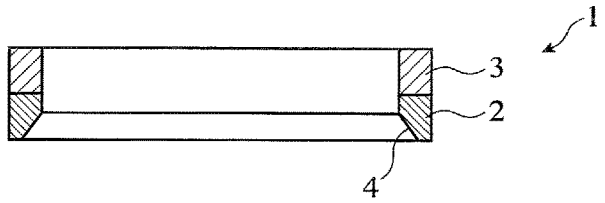
FIG. 1 is a schematic cross-sectional view showing an example of the sintered valve seat of the present invention.
Figure 2:
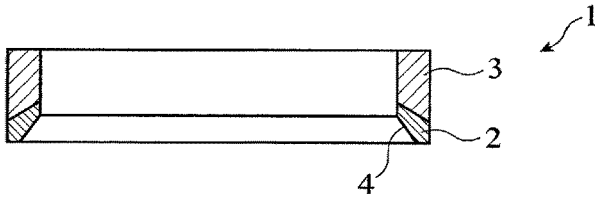
FIG. 2 is a schematic cross-sectional view showing another example of the sintered valve seat of the present invention.

The sintered valve seat of the present invention press-fitted into a cylinder head has a two-layer structure comprising at least a seat layer repeatedly abutting a valve face, and a support layer abutting bottom and inner peripheral surfaces of a valve-seat-press-fitting opening of a cylinder head. FIG. 1 schematically shows an example of the cross section structure of the sintered valve seat 1 of the present invention. A ring-shaped seat layer 2 and a ring-shaped support layer 3 constitute a two-layer structure, the seat layer 2 having on its inner peripheral surface a seat face 4 repeatedly abutting a valve face. FIG. 2 schematically shows another example of the cross section structure of the sintered valve seat of the present invention. The seat layer 2 has a reduced volume, and an outer peripheral surface portion of the support layer 3 in contact with an inner peripheral surface of the valve-seat-press-fitting opening has an increased area. As long as thermal conduction is not hindered, the sintered valve seat of the present invention may have a 3-or-more-layer structure by interposing an intermediate layer (including pluralities of intermediate layers) between the seat layer 2 and the support layer 3 to absorb thermal shrinkage difference between them, thereby preventing cracking, etc.

In the sintered valve seat of the present invention, the seat layer has high thermal conductivity and excellent heat resistance and wear resistance, and the support layer has high thermal conductivity and yield strength and excellent deformation resistance. To secure that the entire sintered valve seat has high thermal conductivity, the matrices of both seat layer and support layer are formed by Cu or its alloy, with Co-based hard particles and/or Fe-based hard particles for heat resistance and wear resistance dispersed in the seat layer, and Fe particles and/or Fe alloy particles for densification and improved strength and deformation resistance dispersed in the support layer. Of course, the Co-based hard particles and/or Fe-based hard particles are harder than the Fe particles and/or Fe alloy particles. The Fe particles and/or Fe alloy particles preferably have Vickers hardness of less than 350 HV0.1. The amount of Co-based hard particles and/or Fe-based hard particles in the seat layer is preferably 25-70% by mass, more preferably 30-65% by mass, further preferably 35-60% by mass. The amount of Fe particles and/or Fe alloy particles in the support layer is preferably 30-70% by mass, more preferably 35-65% by mass, further preferably 40-50% by mass.

The support layer preferably has higher thermal conductivity than that of the seat layer. Specifically, the thermal conductivity of the support layer is preferably 55-90 (W/m)·K, more preferably 60-90 (W/m)·K, further preferably 65-90 (W/m)·K. The thermal conductivity of the seat layer is preferably 30-70 (W/m)·K, more preferably 35-70 (W/m)·K, further preferably 40-70 (W/m)·K.

The volume ratio of the seat layer to the support layer is preferably 25/75 to 70/30, more preferably 25/75 to 60/40, further preferably 25/75 to 50/50.

It is important that the Co-based hard particles and/or the Fe-based hard particles in the seat layer and the Fe particles and/or the Fe alloy particles in the support layer are substantially not dissolved in matrix-constituting Cu. Because Co and Fe are substantially not dissolved in Cu at 600° C. or lower, they can be used as Co-based and Fe-based hard particles. Also, because Mo, W, Cr and V are substantially not dissolved in Cu, they can be used as main alloy elements. Co-based hard particles may be Co—Mo—Cr—Si alloy powder and Co—Cr—W—C alloy powder. Fe-based hard particles may be Fe—Mo—Cr—Si alloy powder. The Co-based hard particles are preferably at least one selected from Co—Mo—Cr—Si alloy particles comprising by mass 27.5-30.0% of Mo, 7.5-10.0% of Cr, and 2.0-4.0% of Si, the balance being Co and inevitable impurities, Co—Cr—W—C alloy particles comprising by mass 27.0-32.0% of Cr, 7.5-9.5% of W, and 1.4-1.7% of C, the balance being Co and inevitable impurities, and Co—Cr—W—C alloy particles comprising by mass 28.0-32.0% of Cr, 11.0-13.0% of W, and 2.0-3.0% of C, the balance being Co and inevitable impurities. The Fe-based hard particles are preferably Fe—Mo—Cr—Si alloy particles comprising by mass 27.5-30.0% of Mo, 7.5-10.0% of Cr, and 2.0-4.0% of Si, the balance being Fe and inevitable impurities. The Vickers hardness of these hard particles is preferably 550-900 HV0.1, more preferably 600-850 HV0.1, further preferably 650-800 HV0.1.

Part (not all) of at least one selected from the Co-based hard particles and the Fe-based hard particles are preferably substituted by second hard particles, which are at least one selected from alloy steel particles comprising by mass 1.4-1.6% of C, 0.4% or less of Si, 0.6% or less of Mn, 11.0-13.0% of Cr, 0.8-1.2% of Mo, and 0.2-3.0% of V, the balance being Fe and inevitable impurities, alloy steel particles comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities, alloy steel particles comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities, and alloy steel particles comprising by mass 0.01% or less of C, 0.3-5.0% of Cr, and 0.1-2.0% of Mo, the balance being Fe and inevitable impurities. These second hard particles are softer than the Co-based hard particles and the Fe-based hard particles. The Vickers hardness of the second hard particles is preferably 300-650 HV0.1, more preferably 400-630 HV0.1, further preferably 550-610 HV0.1. With part (not all) of the Co-based hard particles or the Fe-based hard particles substituted by the second hard particles having lower hardness, the attackability to a valve can be reduced. The substituting amount of the second hard particles is preferably 5-35% by mass, more preferably 15-35% by mass, further preferably 21-35% by mass.

Part (not all) of at least one selected from the Co-based hard particles and the Fe-based hard particles are preferably substituted by third hard particles, which are at least one selected from Fe—Mo—Si alloy particles comprising by mass 40-70% of Mo, and 0.4-2.0% of Si, the balance being Fe and inevitable impurities, $Al_2O_3$ particles, and SiC particles. The Vickers hardness of these third hard particles is preferably 1100-2400 HV0.1. Because the third hard particles improve wear resistance by higher hardness than those of the Co-based hard particles and the Fe-based hard particles, but increase attackability to a valve, their amount should be controlled depending on the properties required.

The support layer of the valve seat of the present invention contains Fe particles and/or Fe alloy particles, which is easily densified by press molding, and improves strength and deformation resistance by forming a skeleton in a soft matrix of Cu or its alloy, in place of hard particles in the seat layer, which are resistant to deformation and hinders densification. The Fe particles preferably consist of 96% or more by mass of Fe and inevitable impurities, and the Fe alloy particles preferably comprise 80% or more by mass of Fe. Specifically, the Fe alloy particles are preferably at least one selected from Fe—Cr alloy particles comprising 0.5-3.0% by mass of Cr, the balance being Fe and inevitable impurities, and Fe—Cr—Mo alloy particles comprising by mass 0.5-5.0% of Cr, and 0.1-2.0% of Mo, the balance being Fe and inevitable impurities. The Fe particles and the Fe alloy particles have Vickers hardness of preferably less than 350 HV0.1, more preferably less than 300 HV0.1.

Part (not all) of at least one selected from the Fe particles and the Fe alloy particles in the support layer are preferably substituted by second hard particles, which are at least one selected from alloy steel particles comprising by mass 1.4-1.6% of C, 0.4% or less of Si, 0.6% or less of Mn, 11.0-13.0% of Cr, 0.8-1.2% of Mo, and 0.2-3.0% of V, the balance being Fe and inevitable impurities, alloy steel particles comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities, alloy steel particles comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities, and alloy steel particles comprising by mass 0.01% or less of C, 0.3-5.0% of Cr, and 0.1-2.0% of Mo, the balance being Fe and inevitable impurities. These second hard particles harder than the Fe particles and the Fe alloy particles have Vickers hardness of preferably 300-650 HV0.1, more preferably 400-630 HV0.1, further preferably 550-610 HV0.1. The substitution of part (not all) of the above Fe particles and Fe alloy particles by the second hard particles having higher hardness prevents deformation and delamination during press molding, and provides the seat layer and the support layer with closer shrinkage ratios to prevent strain and cracking. The amount of the substituting second hard particles is preferably 3-30% by mass, more preferably 5-30% by mass, further preferably 5-25% by mass.

Part (not all) of at least one selected from the Fe particles and the Fe alloy particles are preferably substituted by third hard particles, which are at least one selected from Fe—Mo—Si alloy particles comprising by mass 40-70% of Mo, and 0.4-2.0% of Si, the balance being Fe and inevitable impurities, $Al_2O_3$ particles, and SiC particles. These third hard particles have Vickers hardness of 1100-2400 HV0.1. Because the third hard particles prevent deformation during press molding by higher hardness than those of the second hard particles, their amount should be controlled depending on the properties required.

The sintered valve seat of the present invention preferably contains Fe—P alloy powder for densification. The support layer preferably contains more Fe—P alloy powder than in the seat layer, for improved thermal conductivity, strength and deformation resistance, as well as densification. The amount of P is preferably 0.05-2.2% by mass in the seat layer and 0.1-2.2% by mass in the support layer. Fe—P alloy powder containing 15-32% by mass of P is commercially available. For example, when Fe—P alloy powder containing 26.7% by mass of P is used, the amount of Fe—P alloy powder added is preferably 0.2-8.2% by mass in the seat layer and 0.4-8.2% by mass in the support layer. Because P forms compounds with Co, Cr, Mo, etc., the upper limit of the P content is more preferably 2.5% by mass, further preferably 1.0% by mass.

To obtain a denser sintered body, up to 6.5% by mass of Sn can be added like the Fe—P alloy powder. The addition of a small amount of Sn to the Cu matrix contributes to densification by forming a liquid phase during sintering. However, the addition of a large amount of Sn lowers the thermal conductivity of the Cu matrix, and increases the amount of a low-toughness, low-strength $Cu_3Sn$ compound formed, deteriorating the wear resistance of the sintered body. Accordingly, the upper limit of Sn added is 6.5% by mass. The amount of Sn added is preferably 0.3-2.0% by mass, more preferably 0.3-1.0% by mass.

The sintered valve seat of the present invention may contain a solid lubricant if necessary, in the seat layer. For example, in direct-injection engines undergoing sliding without fuel lubrication, it is necessary to add a solid lubricant to increase self-lubrication, thereby keeping wear resistance. Accordingly, the sintered valve seat of the present invention may contain up to 3% by mass, namely 0-3% by mass, of a solid lubricant. The solid lubricant is preferably selected from carbon, nitrides, oxides, sulfides and fluorides, particularly at least one selected from C, BN, MnS, $CaF_2$, $SiO_2$, $WS_2$, and $Mo_2S$.

The two-layer structure of the sintered valve seat of the present invention is formed by preparing a mixture powder for a support layer and a mixture powder for a seat layer, charging the mixture powder for a support layer into a portion of the die, charging the mixture powder for seat layer on the mixture powder for a support layer in the die, and then press-molding them. The mixture powder for a support layer is prepared by mixing Cu powder, Fe powder and/or Fe alloy powder, and if necessary the second hard particles and/or the third hard particles substituting part of the Fe powder and/or the Fe alloy powder, and Fe—P alloy powder. The mixture powder for a seat layer is prepared by mixing Cu powder, Co-based hard particles and/or Fe-based hard particles, and if necessary the second hard particles and/or the third hard particles substituting part of the Co-based hard powder and/or the Fe-based hard powder, Fe—P alloy powder, Sn powder, and a solid lubricant. To improve compactability, 0.5-2% by mass of stearate as a parting agent may be added to each mixture powder. A green body for a sintered valve seat is sintered at a temperature in a range of 850-1070° C. in vacuum, or in a non-oxidizing or reducing atmosphere.

To form a skeleton in a soft matrix of Cu or its alloy, the above hard particles, Fe particles and Fe alloy particles preferably have a median diameter of 10-150 μm. The median diameter, which corresponds to a diameter d50 at a cumulative volume of 50% in a curve of cumulative volume (obtained by cumulating the particle volume in a diameter range equal to or less than a particular diameter) relative to diameter, can be determined, for example, by using MT3000 II series available from MicrotracBEL Corp. The median diameter is more preferably 50-100 μm, further preferably 65-85 μM.

The hard particles, the Fe particles and the Fe alloy particles used in the sintered valve seat of the present invention are preferably in a spherical shape or in non-spherical irregular shapes. Because the Co-based hard particles and the Fe-based hard particles are resistant to deformation, hindering densification, they are preferably spherical for a higher packing ratio. On the other hand, because spherical hard particles are easily detached from a sliding surface, hard particles in irregular, non-spherical shapes are preferable to prevent detachment. Particularly in the seat layer, spherical hard particles or irregular-shaped hard particles are preferably used depending on the properties required. Of course, a mixture of spherical hard particles and irregular-shaped hard particles may be used. Because hard particles having lower hardness are easily densified, they are preferably in irregular, non-spherical shapes to increase contact of the hard particles to faun a skeleton structure. The spherical hard particles can be formed by gas atomizing, and irregular, non-spherical particles can be formed by pulverization or water atomizing.

Cu powder constituting the matrix preferably has a median diameter of 45 μm or less and purity of 99.5% or more. For a higher packing ratio of powder, Cu powder smaller than the median diameter of hard particles is used. As a result, even with a large amount of hard particles, a network-shaped Cu matrix can be formed. For example, the hard particles preferably have a median diameter of 45 μm or more, and the Cu powder preferably has a median diameter of 30 μm or less. In this respect, the Cu powder is preferably spherical atomized powder. Dendritic powder of electrolytic Cu having fine projections for entanglement is preferably used to form a network-shaped matrix.

Example 1

Electrolytic Cu powder having a median diameter of 22 μm and purity of 99.8% by mass was mixed with 50% by mass of Co-based hard particles (corresponding to Co-based hard particles 1A described later) having a median diameter of 72 μm and comprising by mass 28.5% of Mo, 8.5% of Cr, and 2.6% of Si, the balance being Co and inevitable impurities, and 1.0% by mass of Fe—P alloy powder containing 26.7% by mass of P, to prepare a mixture powder for a seat layer of the sintered valve seat. The Co-based hard particles used were a mixture of spherical particles and irregularly shaped particles. 0.5% by mass of zinc stearate was added to the material powder for good parting in the molding step.

Using electrolytic Cu powder and Fe—P alloy powder for preparing the mixture powder for the seat layer, the electrolytic Cu powder was mixed with 45% by mass of Fe powder having a median diameter of 60 μm and purity of 99.8% by mass (corresponding to Fe or Fe alloy particles 4A described later), and 2.5% by mass of the Fe—P alloy powder, to prepare a mixture powder for a support layer of the sintered valve seat. The Fe particles had irregular shapes and 0.5% by mass of zinc stearate was added.

Predetermined amounts of the mixture powder for the support layer and the mixture powder for the seat layer were successively charged into a molding die, and press-molded at a surface pressure of 640 MPa to form a two-layer green body for a valve seat. The charging and pressing of the mixture powders were conducted such that a layer boundary of the two-layer green body was perpendicular to inner and outer peripheral surfaces of the valve seat as shown in FIG. 1.

Each green body for a valve seat was sintered at a temperature of 1050° C. in vacuum, to produce a ring-shaped sintered body of 40 mm in outer diameter, 18 mm in inner diameter and 8 mm in thickness. Each ring-shaped sintered body was machined to a valve seat sample of 25.8 mm in outer diameter, 21.6 mm in inner diameter and 6 mm in height, which had a seat face inclined from the axial direction by 45°.

Calculation from the size of each layer revealed that a volume ratio of the seat layer to the support layer in the above valve seat was 37/63. Also, the composition analysis of P in the valve seat revealed that P was 0.27% by mass in the seat layer and 0.66% by mass in the support layer. This result is reflected by the amount of the Fe—P alloy powder added.

To confirm the thermal conductivities of the seat layer and the support layer of the above valve seat, the mixture powder for each layer was molded, sintered, and machined to form a test piece of 5 mm Φ×1.3 mm. The thermal conductivity of each test piece was measured by a laser flash method. As a result, the seat layer had thermal conductivity of 50 (W/m)·K, and the support layer had thermal conductivity of 78 (W/m)·K, the thermal conductivity of the support layer being higher than the thermal conductivity of the seat layer.

To confirm the strength of the seat layer and the support layer of the above valve seat, the mixture powder for each layer was molded, and sintered to form a ring-shaped sintered body of 40 mm in outer diameter, 18 mm in inner diameter and 8 mm in thickness. The ring-shaped sintered body was measured with respect to a density and a radial crushing strength. As a result, the seat layer had a density of 7.61 $Mg/m^3$ and a radial crushing strength of 441 MPa, and the support layer had a density of 8.00 $Mg/m^3$ and a radial crushing strength of 710 MPa, the support layer being higher than the seat layer in density and radial crushing strength.

Comparative Example 1

Using a sintered Fe-based alloy containing 10% by mass of Fe—Mo—Si alloy powder (corresponding to third hard particles 3A described later) having a median diameter of 78 μm and comprising by mass 60.1% of Mo, and 0.5% of Si, the balance being Fe and inevitable impurities, for hard particles, a single-layer valve seat sample having the same shape as in Example 1 was produced.

Comparative Example 2

Replacing 50% by mass of Co-based hard particles used for a mixture powder for the seat layer in Example 1 by 35% by mass of the above Co-based hard particles and 15% by mass of alloy steel particles having a median diameter of 84 μm and comprising by mass 0.85% of C, 0.3% of Si, 0.3% of Mn, 3.9% of Cr, 4.8% of Mo, 6.1% of W, and 1.9% of V, the balance being Fe and inevitable impurities, as hard particles, a single-layer valve seat sample having the same shape as in Example 1 was produced.

[1] Measurement of Valve Coolability (Valve Temperature)

Figure 3:
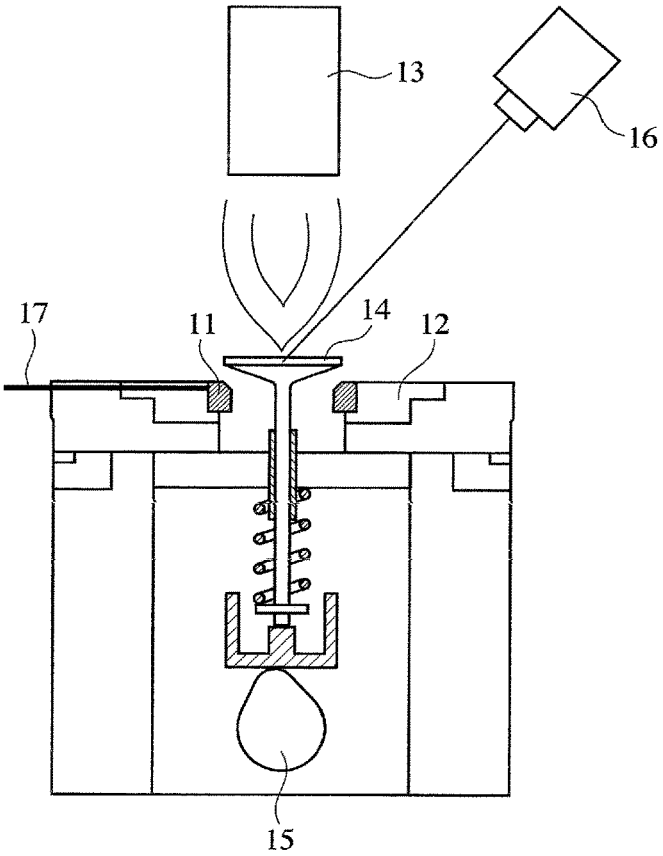
FIG. 3 is a schematic view showing a rig test machine.

Using the rig test machine shown in FIG. 3 the temperature of a valve was measured to evaluate valve coolability. The valve seat sample 11 was press-fitted into a valve seat holder 12 made of a cylinder head material (Al alloy, AC4A), and set in the test machine. The rig test was conducted by moving a valve 14 (SUH alloy, JIS G4311) up and down by rotating a cam 15 while heating the valve 14 by a burner 13. With constant heating by keeping constant the flow rates of air and gas in the burner 13 and the position of the burner, the valve coolability was determined by measuring the temperature of a center portion of a valve head using a thermograph 16. The flow rates (L/min) of air and gas in the burner 13 were 90 L/min and 5.0 L/min, respectively, and the rotation speed of the cam was 2500 rpm. 15 minutes after starting the operation, a saturated valve temperature was measured. In Examples, the valve coolability was expressed by temperature decrement (minus value) from the valve temperature in Comparative Example 1, in place of the saturated valve temperature changeable depending on heating conditions, etc. Though the saturated valve temperature was higher than 800° C. in Comparative Example 1, it was lower than 800° C. in Example 1, with the valve coolability of −58° C. Also, the valve coolability was −30° C. in Comparative Example 2.

[2] Wear Test

After the valve coolability was evaluated, wear resistance was evaluated using the rig test machine shown in FIG. 3. The evaluation was conducted using a thermocouple 17 embedded in the valve seat 11, with the power of the burner 13 adjusted to keep an abutting surface of the valve seat at a predetermined temperature. The wear was expressed by the receding height of the abutting surface determined by the measurement of the shapes of the valve seat and the valve before and after the test. The valve 14 (SUH alloy) used was formed by a Co alloy (Co-20% Cr-8% W-1.35% C-3% Fe) buildup-welded to a size fit to the above valve seat. The test conditions were a temperature of 300° C. (at the abutting surface of the valve seat), a cam rotation speed of 2500 rpm, and a test time of 5 hours. The wear was expressed by a ratio to the wear in Comparative Example 1, which was assumed as 1. As compared with 1 in Comparative Example 1, the wear in Example 1 was 0.71 in the valve seat and 0.92 in the valve, and the wear in Comparative Example 2 was 0.86 in the valve seat and 0.88 in the valve.

[3] Detachment Resistance Test

In a detachment resistance test as an accelerated test, 500 cycles of heating the valve seat 11 to 500° C. and air-cooling it to 50° C. were repeated, and after cooled, a load of extracting the valve seat from the valve seat holder 12 was measured as detachment resistance. In the rig test machine shown in FIG. 3, the valve 14 was not used, and a heat-shielding plate was arranged under valve seat 11. The temperature of the abutting surface of the valve seat was measured by the thermograph 16. The extraction load was measured by a universal test machine. The detachment resistance was expressed by a relative value, assuming that the extraction load in Comparative Example 2, in which the entire valve seat was formed only by the seat layer material, was 1. The detachment resistance in Example 1 was 1.94, relative to Comparative Example 2. The detachment resistance of the valve seat of Comparative Example 1 formed by the sintered Fe-based alloy was 1.8.

Examples 2-45

In Examples 2-45, using the Co-based hard particles and the Fe-based hard particles shown in Table 1, the second hard particles shown in Table 2, the third hard particles shown in Table 3, and the Fe particles and the Fe alloy particles shown in Table 4, in the same manner as in Example 1, mixture powders for seat layers having the compositions shown in Table 5, and mixture powders for support layers having the compositions shown in Table 6 were prepared. Table 5 shows the amounts of Fe—P alloy powder, Sn powder and solid lubricant powder added to the mixture powders for seat layers. With respect to the Co-based or Fe-based hard particles and the second and third hard particles in Tables 1 to 3, their Vickers hardness HV0.1 (embedded in a resin, mirror-polished, and measured under a load of 0.1 kg), median diameters and shapes are shown. Sn powder and solid lubricant powder were not added to the mixture powders for support layers in Table 6.

TABLE 1

| Type | Composition | HV0.1 | d50 | Shape |
|---|---|---|---|---|
| 1A | Co—28.5%Mo—8.5%Cr—2.6%Si | 725 | 72 | Spherical + Irregular |
| 1B | Fe—29.1%Mo—7.9%Cr—2.2%Si | 677 | 66 | Spherical + Irregular |
| 1C | Co—30.0%Cr—8.0%W—1.6%C | 772 | 55 | Spherical |
| 1D | Co—28.0%Cr—4.0%W—1.1%C | 766 | 69 | Spherical |
| 1E | Co—30.0%Cr—12.0%W—2.5%C | 761 | 83 | Spherical |

TABLE 2

| Type | Composition | HV0.1 | d50 | Shape |
|---|---|---|---|---|
| 2A | Fe—0.85%C—0.3%Si—0.3%Mn—3.9%Cr—4.8%Mo—6.1%W—1.9%V | 635 | 84 | Irregular |
| 2B | Fe—0.39%C—0.92%Si—0.34%Mn—5.1%Cr—1.2%Mo—1.1%V | 594 | 88 | Irregular |
| 2C | Fe—1.52%C—0.3%Si—0.3%Mn—11.8%Cr—1.1%Mo—0.3%V | 558 | 61 | Irregular |
| 2D | Fe—3.0%Cr—0.5%Mo | 326 | 67 | Irregular |

TABLE 3

| Type | Composition | HV0.1 | d50 | Shape |
|---|---|---|---|---|
| 3A | Fe—60.1%Mo—0.5%Si | 1224 | 78 | Irregular |
| 3B | SiC | 2308 | 51 | Spherical |
| 3C | $Al_2O_3$ | 1584 | 65 | Irregular |
| 3D | SiC | 2380 | 65 | Irregular |

TABLE 4

| Type | Composition | d50 | Shape |
|---|---|---|---|
| 4A | Fe (99.8%) | 60 | Irregular |
| 4B | Fe—3%Cr—0.5%Mo | 58 | Irregular |
| 4C | Fe—1.5%Cr—0.2%Mo | 63 | Irregular |
| 4D | Fe—1.8%Cr | 55 | Irregular |

TABLE 5

| Seat | Hard Particles: Co-based, Fe-based Hard Particles | | Second Hard Particles | | Third Hard Particles | | Total Amount |
|---|---|---|---|---|---|---|---|
| Layer | Type | %(1) | Type | %(1) | Type | %(1) | % |
| S-1 | 1A | 50 | — | — | — | — | 50 |
| S-2 | 1B | 50 | — | — | — | — | 50 |
| S-3 | 1A, 1B | 30, 20 | — | — | — | — | 50 |
| S-4 | 1C, 1D | 20, 20 | — | — | — | — | 40 |
| S-5 | 1A, 1E | 20, 25 | — | — | — | — | 45 |
| S-6 | 1A | 35 | 2A | 15 | — | — | 50 |
| S-7 | 1A | 25 | 2B | 25 | — | — | 50 |
| S-8 | 1A | 20 | 2A | 30 | — | — | 50 |
| S-9 | 1B | 35 | 2A | 15 | — | — | 50 |
| S-10 | 1B | 21 | 2B | 21 | — | — | 42 |
| S-11 | 1A | 17.5 | 2B | 7.5 | — | — | 25 |
| S-12 | 1B | 30 | 2B | 30 | — | — | 60 |
| S-13 | 1B | 30 | 2C | 30 | — | — | 60 |
| S-14 | 1A | 38 | 2A | 12 | — | — | 50 |
| S-15 | 1A | 8 | 2A | 35 | — | — | 43 |
| S-16 | 1C | 30 | 2C | 35 | — | — | 65 |
| S-17 | 1A, 1B | 20, 5 | 2A | 25 | — | — | 50 |
| S-18 | 1A | 18 | 2A, 2B | 20, 10 | — | — | 48 |
| S-19 | 1D, 1E | 8, 8 | 2A, 2D | 25, 10 | — | — | 51 |
| S-20 | 1A, 1B | 10, 10 | 2B, 2C | 10, 15 | 3A | 15 | 60 |
| S-21 | 1B | 25 | 2A, 2C | 10, 10 | 3B | 5 | 50 |
| S-22 | 1A | 20 | 2C | 30 | — | — | 50 |

| Seat | Fe—P | Sn | Solid Lubricant | |
|---|---|---|---|---|
| Layer | %(1) | %(1) | Type | %(1) |
| S-1 | — | — | — | — |
| S-2 | 1 | — | — | — |
| S-3 | — | 0.5 | — | — |
| S-4 | 1 | — | — | — |
| S-5 | 1 | — | — | — |
| S-6 | 1 | — | — | — |
| S-7 | 0.5 | 1 | — | — |
| S-8 | 1 | — | — | — |
| S-9 | 1 | — | — | — |
| S-10 | 1 | 0.5 | — | — |
| S-11 | 2 | 0.3 | MnS | 1 |
| S-12 | 0.3 | 2 | — | — |
| S-13 | 6.5 | 6.5 | — | — |
| S-14 | 0.5 | 1 | — | — |
| S-15 | 0.5 | — | $CaF_2$ | 3 |
| S-16 | 2.5 | — | — | — |
| S-17 | 1 | 1 | — | — |
| S-18 | 1.5 | — | — | — |
| S-19 | 1 | — | — | — |
| S-20 | 1 | — | — | — |
| S-21 | 1 | — | — | — |
| S-22 | 1 | — | — | — |

Note:
(1)Amount added (%).

TABLE 6

| Seat | Fe Particles, Fe Alloy Particles | | Second Hard Particles | | Third Hard Particles | | Total Amount | Fe—P |
|---|---|---|---|---|---|---|---|---|
| Layer | Type | %(1) | Type | %(1) | Type | %(1) | % | %(1) |
| B-1 | 4A | 45 | — | — | — | — | 45 | 2.5 |
| B-2 | 4A | 40 | — | — | — | — | 40 | 2 |
| B-3 | 4D | 50 | — | — | — | — | 50 | 1.5 |
| B-4 | 4A, 4C | 40, 5 | — | — | — | — | 45 | 1 |
| B-5 | 4A, 4D | 30, 10 | — | — | — | — | 40 | 2 |
| B-6 | 4B, 4C | 10, 40 | — | — | — | — | 50 | 2 |
| B-7 | 4B, 4D | 5, 40 | — | — | — | — | 45 | 1.5 |
| B-8 | 4A | 45 | 2A | 5 | — | — | 50 | 2 |
| B-9 | 4B | 35 | 2B | 15 | — | — | 50 | 2.5 |

TABLE 6-continued

| Seat | Fe Particles, Fe Alloy Particles | | Second Hard Particles | | Third Hard Particles | | Total Amount | Fe—P |
|---|---|---|---|---|---|---|---|---|
| Layer | Type | %(1) | Type | %(1) | Type | %(1) | % | %(1) |
| B-10 | 4A | 30 | 2C | 20 | — | — | 50 | 2 |
| B-11 | 4B | 45 | — | — | 3A | 5 | 50 | 1.5 |
| B-12 | 4B | 40 | — | — | 3D | 10 | 50 | 2 |
| B-13 | 4A | 48 | — | — | 3C | 5 | 50 | 1.5 |
| B-14 | 4A | 38 | 2C | 8 | 3D | 4 | 50 | 2.5 |
| B-15 | 4B | 35 | 2B | 8 | 3C | 2 | 45 | 2 |

Note:
(1)Amount added (%).

In Examples 2-32 and 36-45, valve seat samples were produced in the same manner as in Example 1, with combinations of seat layers and support layer shown in Table 7 with varied volume ratios of the seat layers to the support layers, and the seat layer/support layer volume ratios, the valve coolability, the wear test, and the detachment resistance were measured in the same manner as in Example 1. In Examples 33-35, a two-layer green body having the layer boundary shown in FIG. 2 was produced, with each support layer formed by a die inclined 45° inside. In Example 10, the cross-section microstructures of the seat layer and the support layer were observed by a scanning electron microscope.

Figure 4A:
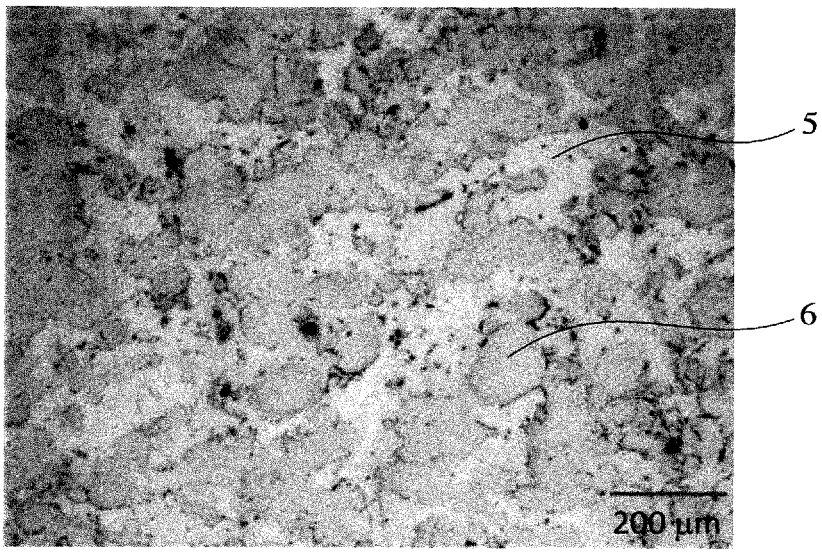
FIG. 4(*a*) is a scanning electron photomicrograph showing a cross-section structure of the seat layer of Example 1.
Figure 4B:
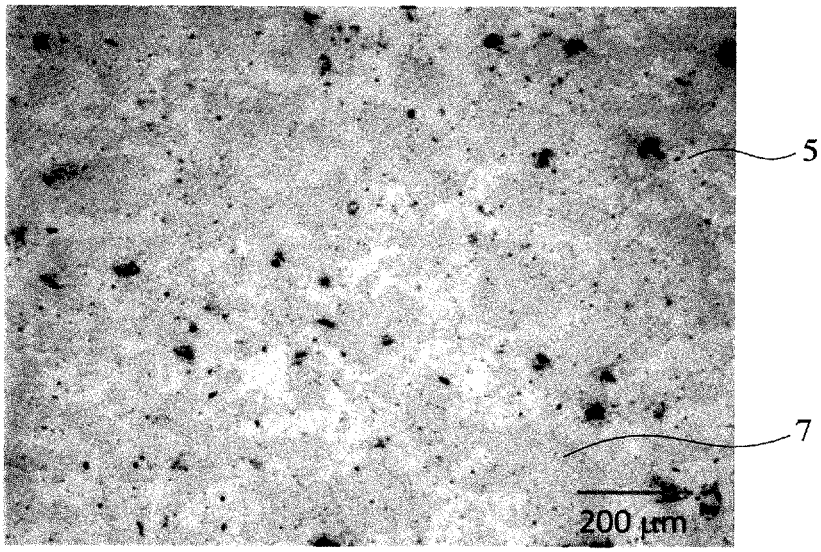

In Example 10, the scanning electron photomicrograph of the seat layer is shown in FIG. 4(*a*), and the scanning electron photomicrograph of the support layer is shown in FIG. 4(*b*). In the photomicrograph of the seat layer of FIG. 4(*a*), a Cu matrix 5 and hard particles 6 (Co-based hard particles [hard particles 1A] and the second hard particles [2A]) were distributed in interacting with each other, and the Cu matrix 5 was mostly continuous despite partial disconnection. Because the hard particles 6 are resistant to deformation, it was observed that they kept their particle shapes, with gaps between the particles and in the boundaries of particles and the Cu matrix. On the other hand, in the microscopic structure of the support layer of FIG. 4(*b*), the Cu matrix 5 and the Fe particles 7 (Fe particles 4A) were distributed in interacting with each other, and the Cu matrix was sufficiently continuous. It was also observed that the Fe particles/Cu matrix boundaries were closely bonded, indicating that the support layer was denser than the seat layer. With hard particles having d50 of 72 and 84 μm dispersed in the seat layer, and Fe particles having d50 of 60 μm dispersed in the support layer, the support layer had a slightly finer structure than that of the seat layer.

The measurement results of seat layer/support layer volume ratios, valve coolability, wear and detachment resistance in Examples 2-45 are shown in Table 7, together with those of Example 1 and Comparative Examples 1 and 2.

TABLE 7

| No. | Valve Seat: Seat Layer | Support Layer | Volume Ratio(1) (%) | Valve Coolability (° C.) |
|---|---|---|---|---|
| Example 1 | S-1 | B-1 | 36/64 | −58 |
| Example 2 | S-2 | B-2 | 42/58 | −55 |
| Example 3 | S-3 | B-3 | 51/49 | −51 |
| Example 4 | S-4 | B-4 | 45/55 | −56 |
| Example 5 | S-5 | B-5 | 49/51 | −49 |
| Example 6 | S-3 | B-6 | 52/48 | −47 |
| Example 7 | S-3 | B-7 | 34/66 | −64 |
| Example 8 | S-6 | B-1 | 39/61 | −63 |

TABLE 7-continued

| | | | | |
|---|---|---|---|---|
| Example 9 | S-7 | B-2 | 48/52 | −58 |
| Example 10 | S-8 | B-1 | 49/51 | −68 |
| Example 11 | S-9 | B-4 | 50/50 | −43 |
| Example 12 | S-10 | B-1 | 37/63 | −63 |
| Example 13 | S-11 | B-2 | 25/75 | −68 |
| Example 14 | S-12 | B-3 | 51/49 | −39 |
| Example 15 | S-13 | B-4 | 48/52 | −61 |
| Example 16 | S-14 | B-5 | 47/53 | −60 |
| Example 17 | S-15 | B-6 | 39/61 | −57 |
| Example 18 | S-17 | B-7 | 37/63 | −59 |
| Example 19 | S-18 | B-6 | 42/58 | −54 |
| Example 20 | S-6 | B-1 | 39/61 | −60 |
| Example 21 | S-7 | B-2 | 43/57 | −62 |
| Example 22 | S-8 | B-3 | 37/63 | −63 |
| Example 23 | S-9 | B-1 | 36/64 | −66 |
| Example 24 | S-10 | B-1 | 34/66 | −58 |
| Example 25 | S-11 | B-2 | 47/53 | −51 |
| Example 26 | S-12 | B-3 | 33/67 | −59 |
| Example 27 | S-13 | B-3 | 33/67 | −58 |
| Example 28 | S-14 | B-4 | 40/60 | −55 |
| Example 29 | S-22 | B-2 | 40/60 | −56 |
| Example 30 | S-16 | B-7 | 45/55 | −62 |
| Example 31 | S-19 | B-7 | 54/46 | −41 |
| Example 32 | S-20 | B-6 | 58/42 | −37 |
| Example 33 | S-21 | B-3 | 66/34 | −38 |
| Example 34 | S-6 | B-7 | 84/16 | −33 |
| Example 35 | S-7 | B-7 | 72/28 | −34 |
| Example 36 | S-12 | B-8 | 36/64 | −66 |
| Example 37 | S-17 | B-9 | 45/55 | −54 |
| Example 38 | S-22 | B-14 | 60/40 | −42 |
| Example 39 | S-18 | B-11 | 38/62 | −56 |
| Example 40 | S-19 | B-12 | 49/51 | −41 |
| Example 41 | S-22 | B-10 | 50/50 | −50 |
| Example 42 | S-1 | B-15 | 55/45 | −46 |
| Example 43 | S-7 | B-13 | 40/60 | −53 |
| Example 44 | S-8 | B-8 | 56/44 | −45 |
| Example 45 | S-6 | B-9 | 62/38 | −40 |
| Com. Ex. 1 | | — | — | 0 |
| Com. Ex. 2 | | S-6 | 100/0 | −30 |

| No. | Wear Test | | Detachment |
|---|---|---|---|
| | Seat Wear | Valve Wear | Resistance |
| Example 1 | 0.71 | 0.92 | 1.94 |
| Example 2 | 0.75 | 0.89 | 1.92 |
| Example 3 | 0.79 | 0.84 | 1.89 |
| Example 4 | 0.74 | 0.97 | 1.95 |
| Example 5 | 0.77 | 91 | 1.91 |
| Example 6 | 0.82 | 0.87 | 1.88 |
| Example 7 | 0.79 | 0.94 | 2.05 |
| Example 8 | 0.84 | 0.87 | 1.9 |
| Example 9 | 0.83 | 0.86 | 1.8 |
| Example 10 | 0.89 | 0.89 | 1.95 |
| Example 11 | 0.83 | 0.84 | 1.79 |
| Example 12 | 0.91 | 0.95 | 1.98 |
| Example 13 | 0.93 | 0.9 | 2.1 |
| Example 14 | 0.81 | 0.85 | 1.75 |
| Example 15 | 0.82 | 0.87 | 1.68 |
| Example 16 | 0.81 | 0.98 | 1.77 |
| Example 17 | 0.96 | 0.87 | 1.85 |
| Example 18 | 0.84 | 0.87 | 1.9 |
| Example 19 | 0.88 | 0.91 | 1.84 |
| Example 20 | 0.92 | 0.92 | 2.05 |
| Example 21 | 0.89 | 0.86 | 1.93 |
| Example 22 | 0.89 | 0.87 | 1.89 |
| Example 23 | 0.9 | 0.84 | 1.9 |
| Example 24 | 0.84 | 0.84 | 1.8 |
| Example 25 | 0.85 | 0.89 | 1.74 |
| Example 26 | 0.91 | 0.87 | 1.85 |
| Example 27 | 0.85 | 0.89 | 1.88 |
| Example 28 | 0.92 | 0.9 | 1.77 |
| Example 29 | 0.85 | 0.87 | 1.78 |
| Example 30 | 0.86 | 0.87 | 1.85 |
| Example 31 | 0.91 | 0.84 | 1.79 |
| Example 32 | 0.94 | 0.82 | 1.66 |
| Example 33 | 0.98 | 0.78 | 1.65 |
| Example 34 | 1.15 | 1.22 | 1.58 |
| Example 35 | 1.2 | 1.25 | 1.61 |
| Example 36 | 0.8 | 0.89 | 1.89 |

TABLE 7-continued

| | | | |
|---|---|---|---|
| Example 37 | 0.86 | 0.9 | 1.79 |
| Example 38 | 0.88 | 0.91 | 1.55 |
| Example 39 | 0.9 | 0.88 | 1.92 |
| Example 40 | 0.84 | 0.86 | 1.78 |
| Example 41 | 0.89 | 0.93 | 1.77 |
| Example 42 | 0.93 | 0.95 | 1.83 |
| Example 43 | 0.86 | 0.86 | 1.73 |
| Example 44 | 0.84 | 0.93 | 1.72 |
| Example 45 | 0.86 | 0.91 | 1.62 |
| Com. Ex. 1 | 1 | 1 | 1.8 |
| Com. Ex. 2 | 0.86 | 0.88 | 1 |

Note:
(1)The volume ratio of a seat layer to a support layer.

The sintered valve seats of the present invention exhibited wear resistance equal to or higher than that of the sintered Fe-based alloy valve seats, and detachment resistance comparable to that of the sintered Fe-based alloy valve seats because of the two-layer structure of a seat layer and a support layer. Further, it appears to exhibit better valve coolability as the volume ratio of a support layer increases.

DESCRIPTION OF REFERENCE NUMERALS

1: Sintered valve seat
2: Seat layer
3: Support layer
4: Seat face
5: Cu matrix
6: Hard particle
7: Fe particle
11: Valve seat sample
12: Valve seat holder
13: Burner
14: Valve
15: Cam
16: Thermograph
17: Thermocouple

What is claimed is:

1. A sintered valve seat press-fitted into a cylinder head of an internal engine;

said valve seat having a two-layer structure comprising a seat layer repeatedly abutting a valve face, and a support layer abutting bottom and inner peripheral surfaces of a valve-seat-press-fitting opening of a cylinder head;

said seat layer containing at least one selected from Co-based hard particles and Fe-based hard particles in a matrix of Cu or its alloy; and said support layer containing at least one selected from Fe particles and Fe alloy particles in a matrix of Cu or its alloy.

2. The sintered valve seat according to claim 1, wherein said seat layer contains 25-70% by mass of at least one selected from Co-based hard particles and Fe-based hard particles; and said support layer contains 30-70% by mass of at least one selected from Fe particles and Fe alloy particles.

3. The sintered valve seat according to claim 1, wherein said support layer has higher thermal conductivity than that of said seat layer.

4. The sintered valve seat according to claim 1, wherein the volume ratio of said seat layer to said support layer is 25/75-70/30.

5. The sintered valve seat according to claim 1, wherein said Co-based hard particles contained in said seat layer are at least one selected from Co—Mo—Cr—Si alloy particles comprising by mass 27.5-30.0% of Mo, 7.5-10.0% of Cr, and 2.0-4.0% of Si, the balance being Co and inevitable impurities, Co—Cr—W—C alloy particles comprising by mass 27.0-32.0% of Cr, 7.5-9.5% of W, and 1.4-1.7% of C, the balance being Co and inevitable impurities, and Co—Cr—W—C alloy particles comprising by mass 28.0-32.0% of Cr, 11.0-13.0% of W, and 2.0-3.0% of C, the balance being Co and inevitable impurities; and said Fe-based hard particles contained in said seat layer are Fe—Mo—Cr—Si alloy particles comprising by mass 27.5-30.0% of Mo, 7.5-10.0% of Cr, and 2.0-4.0% of Si, the balance being Fe and inevitable impurities.

6. The sintered valve seat according to claim 1, wherein in said support layer, said Fe particles are Fe particles comprising 96% or more by mass of Fe and inevitable impurities; and said Fe alloy particles are at least one selected from Fe—Cr alloy particles comprising 0.5-3.0% by mass of Cr, the balance being Fe and inevitable impurities, and Fe—Cr—Mo alloy particles comprising by mass 0.5-5.0% of Cr, and 0.1-2.0% of Mo, the balance being Fe and inevitable impurities.

7. The sintered valve seat according to claim 5, wherein part of at least one selected from said Co-based hard particles and said Fe-based hard particles, which are contained in said seat layer, are substituted by second hard particles; and said second hard particles are at least one selected from alloy steel particles comprising by mass 1.4-1.6% of C, 0.4% or less of Si, 0.6% or less of Mn, 11.0-13.0% of Cr, 0.8-1.2% of Mo, and 0.2-3.0% of V, the balance being Fe and inevitable impurities, alloy steel particles comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities, alloy steel particles comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities, and alloy steel particles comprising by mass 0.01% or less of C, 0.3-5.0% of Cr, and 0.1-2.0% of Mo, the balance being Fe and inevitable impurities.

8. The sintered valve seat according to claim 7, wherein part of at least one selected from said Co-based hard particles and said Fe-based hard particles, which are contained in said seat layer, are substituted by third hard particles;

said third hard particles are at least one selected from Fe—Mo—Si alloy particles comprising by mass 40-70% of Mo, and 0.4-2.0% of Si, the balance being Fe and inevitable impurities, $Al_2O_3$ particles, and SiC particles.

9. The sintered valve seat according to claim 6, wherein part of at least one selected from said Fe particles and said Fe alloy particles, which are contained in said support layer, are substituted by second hard particles; and said second hard particles are at least one selected from alloy steel particles comprising by mass 1.4-1.6% of C, 0.4% or less of Si, 0.6% or less of Mn, 11.0-13.0% of Cr, 0.8-1.2% of Mo, and 0.2-3.0% of V, the balance being Fe and inevitable impurities, alloy steel particles comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities, and alloy steel particles comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities.

10. The sintered valve seat according to claim 9, wherein part of at least one selected from said Fe particles and said Fe alloy particles, which are contained in said support layer, are substituted by third hard particles; and said third hard particles are at least one selected from Fe—Mo—Si alloy particles comprising by mass 40-70% of Mo, and 0.4-2.0% of Si, the balance being Fe and inevitable impurities, $Al_2O_3$ particles, and SiC particles.

11. The sintered valve seat according to claim 1, wherein said seat layer contains 0.05-2.2% by mass of P.

12. The sintered valve seat according to claim 1, wherein said support layer contains 0.1-2.2% by mass of P.

13. The sintered valve seat according to claim 1, wherein said seat layer contains up to 6.5% by mass of Sn.

14. The sintered valve seat according to claim 1, wherein said seat layer contains up to 3% by mass of a solid lubricant.

15. The sintered valve seat according to claim 14, wherein said solid lubricant is at least one selected from the group consisting of C, BN, MnS, $CaF_2$, $SiO_2$, $WS_2$ and $Mo_2S$.

* * * * *